US006454900B2

(12) United States Patent
Bokström et al.

(10) Patent No.: US 6,454,900 B2
(45) **Date of Patent: *Sep. 24, 2002**

(54) METHOD FOR TWO-STAGE OXYGEN DELIGNIFICATION OF CHEMICAL PULP

(75) Inventors: Monica Bokström, Kovland; Pia Mellander, Sundsvall; Solveig Nordén, Njurunda, all of (SE)

(73) Assignee: Sunds Defibrator Industries AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,913

(22) Filed: Jun. 21, 2001

Related U.S. Application Data

(63) Continuation of application No. 09/759,032, filed on Jan. 12, 2001, now Pat. No. 6,319,357, which is a continuation of application No. 08/927,925, filed on Sep. 11, 1997, now Pat. No. 6,221,206, which is a continuation of application No. 08/555,086, filed on Nov. 8, 1995, now abandoned.

(30) Foreign Application Priority Data

Oct. 23, 1995 (SE) ..... 9503720

(51) Int. Cl.[7] ..... D21C 3/26; D21C 9/147
(52) U.S. Cl. ..... 162/19; 162/65
(58) Field of Search ..... 162/19, 65, 52, 162/90

(56) References Cited

U.S. PATENT DOCUMENTS

| | | | | |
|---|---|---|---|---|
| 4,946,556 | A | 8/1990 | Prough | 162/60 |
| 5,034,095 | A | 7/1991 | Kido et al. | 162/65 |
| 5,217,575 | A | 6/1993 | Backlund | 162/65 |

FOREIGN PATENT DOCUMENTS

| | | | |
|---|---|---|---|
| WO | 95/08664 | 3/1995 | 162/65 |

OTHER PUBLICATIONS

Rudra P. Singh, *The Bleaching of Pulp*, 3rd Ed., Revised.

S. Kondo, *Two–Stage MC–Oxygen Delignification Process and Operating Experiences*, Proceedings '92 PAN–PAC PPTC, pp. 23–31—Comparison Tables attached.

Y. Miyata, *Operating Experiences with 2–stage Oxygen Delignification at Chuetsu, Sendal Mill*, Kamyr Gotaverken Symposium, Toyko, 1993.

A. Backlund, *Kamyr's Fiberline for Bleached Pulp with Environment in Focus*, 1989.

Pulp and Paper Manufacture, vol. 5, Alkaline Pulping (1989) pp. 45658.

N. Hartler et al., *Oxygen–Alkali Bleaching of Sulphate Pulp*, Svensk Papperstidning, pp. 696–03 (1970).

L. Nasman et al., *Medium–Consistency Oxygen Bleaching*, Tappi 63(4):105–09 (1980).

Tappi Specification T 236cm–5, *Kappa Number of Pulp*, copyright 1984.

Almberg et al., *Oxygen Delignification as Part of Future Mill Systems*, Tappi 62(6):33–35.

*Primary Examiner*—Steve Alvo
(74) *Attorney, Agent, or Firm*—Lerner, David, Littenberg, Krumholz & Mentlik, LLP

(57) ABSTRACT

Methods for oxygen delignification of a pulp are disclosed, including initially delignifying the pulp at a delignification temperature of less than 90° C., adding oxygen to the pulp so that the oxygen is present during the initial delignification step, and further delignifying the pulp at a delignification temperature of greater than 90° C., the difference between the two delignification temperatures being less than about 20° C., and the pressure being greater in the initial delignification step. The method also includes adding alkali solely to the initial delignification step in order to obtain high alkalinity therein.

11 Claims, 1 Drawing Sheet

METHOD FOR TWO-STAGE OXYGEN DELIGNIFICATION OF CHEMICAL PULP

CROSS-REFERENCE TO RELATED APPLICATIONS

This is a continuation application of U.S. patent application Ser. No. 09/759,032 filed Jan. 12, 2001, now U.S. Pat. No. 6,319,357 which is a continuation of U.S. patent application Ser. No. 08/927,925 filed Sep. 11, 1997, which issued as U.S. Pat. No. 6,221,206 on Apr. 24, 2001, which is a continuation of U.S. patent application Ser. No. 08/555,086 filed Nov. 8, 1995, now abandoned.

BACKGROUND OF THE INVENTION

The present invention relates to a method of oxygen delignification of lignocellulosic material, preferably at medium concentration, i.e., between about 8 and 16%.

Since the original introduction of oxygen delignification operating at medium pulp concentrations not much development work has been devoted to this process. Since the use of chlorine free bleaching and the closing of bleach plants have become matters of immediate interest, extended delignification, i.e., the (a) further lowering of the kappa number by means of oxygen has increasingly become more interesting. Extended delignification by oxygen in one or several steps, however, can result in a deterioration in pulp quality. The use of the appropriate conditions, however, can yield several advantages.

It should thus be possible to maintain the yield of the pulp at a higher level than is the case with extended cooking, i.e., cooking to lower the kappa number.

In a multi-step method it should be possible to distribute the chemicals between the steps in order to obtain optimum conditions in every step. Even other conditions could then be optimized.

SUMMARY OF THE INVENTION

In accordance with the present invention, these and other objectives have now been met by the invention of a method for oxygen delignification of a pulp comprising cellulosic material comprising initially delignifying the pulp at an initial delignification temperature of less than 90° C. and an initial delignification pressure so as to produce a partially delignified pulp, adding oxygen to the pulp so that the oxygen is present during the initial delignification step, and subsequently delignifying the partially delignified pulp at a subsequent delignification temperature of greater than 90° C., and a subsequent delignification pressure, the difference between the initial delignification temperature and the subsequent delignification temperature being less than about 20° C., the initial delignification pressure being greater than the subsequent delignification pressure, the method including adding alkali solely to the initial delignification step in order to obtain a high alkalinity therein.

In accordance with one embodiment of the method of the present invention, initial delignifying of the pulp is carried out for an initial residence time of between about 10 and 30 minutes, and subsequent delignifying of the partially delignified pulp is carried out for a subsequent residence time of between about 45 and 180 minutes. Preferably, the initial residence time is between about 15 and 25 minutes and the subsequent residence time is between about 60 and 120 minutes.

In accordance with another embodiment of the method of the present invention, the initial delignifying pressure is between about 4 and 10 bars and the subsequent delignifying pressure is between about 2 and 5 bar.

In accordance with another embodiment of the method of the present invention, the method includes adding the oxygen to the pulp in an amount of between about 25 and 50 kg per ton of pulp.

In accordance with another embodiment of the method of the present invention, the method includes adding the alkali to the initial delignification step in an amount of between about 25 and 50 kg of alkali per tone of pulp.

In accordance with another embodiment of the method of the present invention, the difference between the initial delignification temperature and the subsequent delignification temperature is between about 10 and 15° C.

In accordance with another embodiment of the method of the present invention, the method includes adding oxygen to the partially delignified pulp in an amount of up to about 5 kg per ton of pulp.

The present invention thus relates to a method of extended oxygen delignification so that a lower kappa number is obtained without at the same time deteriorating the properties of the pulp. By carrying out extended delignification according to the present invention, the total delignification can amount to between about 50 and 70% of the lignin content (kappa number) of the unbleached pulp. The method is carried out at medium pulp concentrations in two subsequent steps.

BRIEF DESCRIPTION OF THE DRAWINGS

The invention is described in greater detail in the following detailed description, with reference to the accompanying FIGURE, in which is shown a schematic view of an installation for carrying out a method according to the present invention.

DETAILED DESCRIPTION

Figure 1:
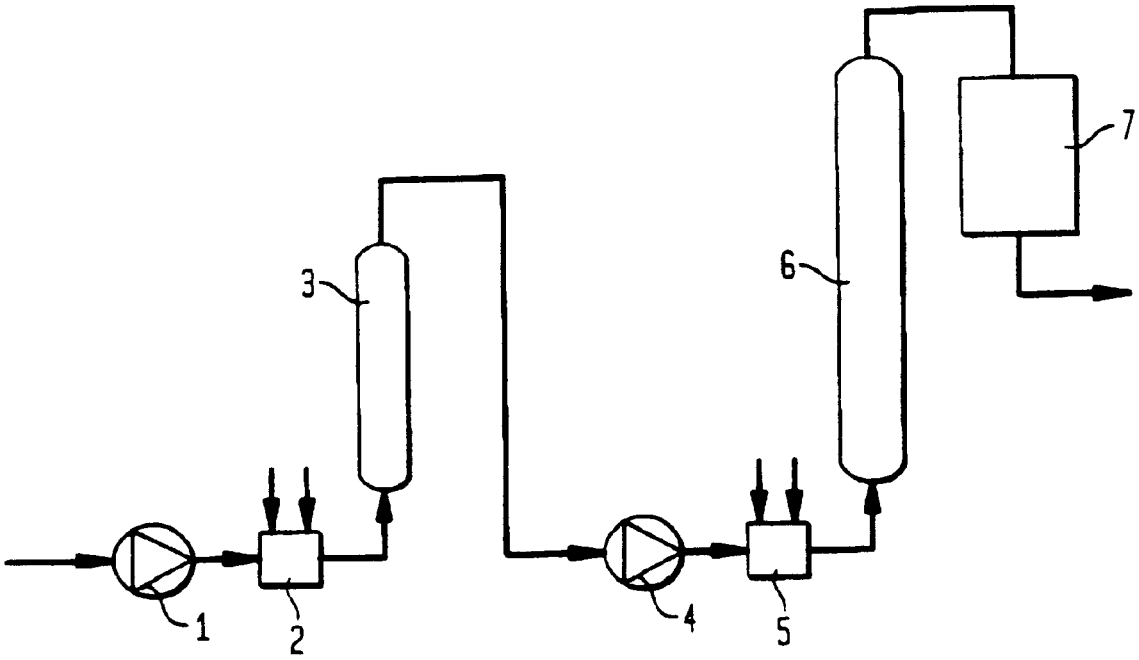

Referring to the FIGURE, in the installation shown therein, digested pulp at a medium concentration, i.e. between about 8 and 16%, is pumped by a first pump 1 from brown pulp washing to oxygen delignification. A first mixer 2 is used for admixing oxygen and alkali to the pulp. The pulp is thereafter fed into a first reactor 3, in which the first or initial delignification step is carried out. The pulp is then directed from there, possibly by a second pump 4 through a second mixer 5, preferably for admixing steam and possibly additional oxygen, to a second reactor 6 for the second or subsequent delignification step. After the second reactor 6 the pulp is then fed to a blow tank 7, and from there to subsequent processing steps.

The method hereof thus implies that the delignification is carried out in two subsequent steps. In the first mixer 2 both high alkali additions and high oxygen additions are made. To achieve these results a charge of between about 25 and 50 kg of alkali (NaOH) per ton of pulp, and preferably between about 25 and 35 kg/ton is utilized. This necessary alkali charge can possibly be partially obtained by a carry-over form the brown pulp washing. The charge in the mixer 2 can then be reduced to a corresponding degree. The oxygen charge shall thus be between about 25 and 50 kg/ton of pulp, and preferably between about 30 and 40 kg/ton.

The temperature of the pulp when it is fed into the reactor 3 shall be below 90° C., and preferably between about 75 and 90° C. This implies that the reaction in the first step in reactor 3 can be carried out at the temperature of the pulp when it comes from the brown pulp washing. The residence time in reactor 3 shall be relatively short, i.e., between about 10 and 30 minutes, and preferably between about 15 and 25 minutes.

The pressure in the first reactor 3 should be between about 4 and 10 bar. The high pressure, combined with the high alkalinity of the pulp and the high oxygen charge, results in a high speed delignification. At the same time, the speed of cellulose degradation is held to a relatively low level, due to the relatively low temperature and short residence time.

After the first delignification step in the first reactor 3 the pulp is fed to the second delignification step in the second reactor 6. The temperature in the second reactor 6 shall be above 90° C., i.e., higher than in the first reactor 3. The difference in temperature, however, shall be less than 20° C., and preferably between about 10 and 15° C. In order to bring about the required increase in temperature, steam is supplied to the second mixer 5.

The pressure in the second reactor 6 shall be between about 2 and 5 bar, and lower than in the first reactor 3. The residence time should be relatively long, i.e., between about 45 and 180 minutes, and preferably between about 60 and 120 minutes.

The second delignification step is primarily a long extraction step in which, in relation to the first step, the increased temperature and the extended residence time yield extended delignification. At temperatures above 90° C., excellent extraction/leaching speeds are thus obtained.

Due to the fact that no additional alkali is charged in the second step, not even for compensating for the consumption in the first step, the alkalinity of the pulp can be held relatively low in the second step. In this manner, cellulose degradation is substantially avoided, in spite of the high temperatures and long residence times.

In the second mixer 5 it is possible that a small amount of oxygen can be added, which can be up to about 5 kg/ton of pulp. The oxygen charge in the first step can thereby be completed in order to increase the partial pressure of the oxygen.

The residence time in the second step is determined in relation to the temperature, in order to achieve optimum results, i.e., intended extended delignification without deterioration of the pulp properties. Higher temperatures thus mean shorter residence time.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method of bleaching chemical pulp comprising the steps of:

(a) delignifying the pulp in a first oxygen delignification stage to which oxygen and alkali are added at a first alkali charge, at a first pressure of 4 to 10 bar and at a first temperature less than 90° C.; and then (b) further delignifying the pulp in a second oxygen delignification stage at a second pressure lower than said first pressure and at a second temperature greater than said first temperature, said second temperature being greater than 90° C. and less than 20° C. higher than said first temperature, the alkalinity in the second stage being lower than in the first stage.

2. A method as claimed in claim 1, wherein said second pressure is 2 to 5 bar.

3. A method as claimed in claim 1, wherein said pulp is delignified in said first stage for a first residence time and further delignified in said second stage for a second residence time longer than said first residence time.

4. A method as claimed in claim 1, wherein said pulp is delignified in said first stage for a first residence time of 10 to 30 minutes and further delignified in said second stage for a second residence time of 45 to 180 minutes.

5. A method as claimed in claim 4, wherein said first residence time is 15 to 25 minutes and said second residence time is 60 to 120 minutes.

6. A method as claimed in claim 1, wherein said alkali in said first stage is added as a charge of 25 to 50 kg of alkali per ton of pulp.

7. A method as claimed in claim 1, wherein said second delignification stage is conducted without charging additional alkali into said pulp.

8. A method as claimed in claim 1, wherein said second temperature is less than 15° C. higher than said first temperature.

9. A method as claimed in claim 1, wherein said second delignification stage is conducted without adding additional oxygen thereto.

10. A method as claimed in claim 1, wherein said oxygen in said first stage is provided by adding 25 to 50 kg of oxygen per ton of pulp to said first delignification stage.

11. A method as claimed in claim 1, wherein up to 5 kg of oxygen per ton of pulp is added to said pulp after said first delignification stage.

* * * * *